US005992115A

United States Patent [19]

Felix

[11] Patent Number: 5,992,115

[45] Date of Patent: Nov. 30, 1999

[54] METHOD AND APPARATUS FOR INSTALLING V-CAP IN COUNTERTOP ASSEMBLIES

[76] Inventor: Gregory S. Felix, 9593 Chimizu River Cir., Fountain Valley, Calif. 92708

[21] Appl. No.: 09/110,587

[22] Filed: Jul. 6, 1998

Related U.S. Application Data

[63] Continuation-in-part of application No. 09/033,494, Mar. 2, 1998, abandoned.

[51] Int. Cl.[6] ..... A47B 13/08

[52] U.S. Cl. ..... 52/465; 52/782.24; 52/796.12; 52/797.1; 52/800.11; 52/800.18; 52/718.01; 52/718.02; 52/288.1

[58] Field of Search ..... 52/782.2, 782.24, 52/796.12, 797.1, 800.11, 800.18, 718.01, 718.04, 465, 707, 718.05, 718.02, 698, 125.4, 288.1; 312/140.1, 140.4

[56] References Cited

U.S. PATENT DOCUMENTS

| | | | |
|---|---|---|---|
| 992,877 | 5/1911 | Kahn | 52/707 |
| 1,815,167 | 7/1931 | Soper | 52/800.18 X |
| 2,272,058 | 2/1942 | Dieter et al. | 52/796.12 X |
| 2,705,820 | 4/1955 | Torrence | 52/782.2 |
| 3,151,713 | 10/1964 | Henrikson et al. | 52/782.2 X |
| 3,320,712 | 5/1967 | Rapata | 52/718.01 X |
| 3,687,496 | 8/1972 | Hindin | 52/800.18 X |
| 4,000,591 | 1/1977 | Courtois | 52/707 X |
| 4,748,780 | 6/1988 | Vinther | 52/782.2 X |
| 5,729,951 | 3/1998 | Frohlich | 52/707 X |

FOREIGN PATENT DOCUMENTS

| | | | |
|---|---|---|---|
| 1470419 | 2/1967 | France | 52/718.01 |

OTHER PUBLICATIONS

"V–Cap Trim Installation," by Ceramic Tile Institute of Northern Ca. Technical Committee, p. 2, Oct., 1995.

*Primary Examiner*—Christopher T. Kent
*Assistant Examiner*—Brian E. Glessner
*Attorney, Agent, or Firm*—Price, Gess & Ubell

[57] ABSTRACT

An anchor component having a stem portion terminating in an enlarged end portion is used to anchor cap strip to a surrounding mortar bed. The stem portion is attached to the cap strip by an integrally formed head which interlocks with a hole in the cap strip or by being prefabricated to be punched out of the cap strip. The assembly is designed to prevent cracking of overlying V-Cap.

25 Claims, 5 Drawing Sheets

METHOD AND APPARATUS FOR INSTALLING V-CAP IN COUNTERTOP ASSEMBLIES

This application is a continuation-in-part of U.S. patent application Ser. No. 09/033,494, filed on Mar. 2, 1998 now abandoned.

BACKGROUND OF THE INVENTION

1. Field of the Invention

The subject invention relates generally to tile installation and more particularly to an improved method and apparatus for installing V-Cap so as to avoid cracking thereof.

2. Description of Related Art

So-called "V-Cap" is a tile component typically used to finish off the front of tiled countertops. The V-Cap is typically bonded to an underlying mortar bed by an adhesive, which is typically a thin set mortar. Since at least 1968, punched metal strip or "cap strip" has been used to support V-Cap in tile installations. Since at least that date, a problem has existed with thin hairline cracks developing in V-Cap installations.

Various approaches have been tried to solve this cracking problem. In 1995, the Ceramic Tile Institute of Northern California Technical Committee reported on such approaches as follows:

> Throughout the years installers have improvised in an attempt to eliminate cracking in their countertop installations. Some have resorted to eliminating the adhesive to only the apron, allowing the top surface of the V-Cap to freely float upon the mortar bed. Still others have fastened the V-Caps with thin set applied only on the top surface, allowing the Cap to hang freely against the apron, sometimes allowing a space for movement there. Still others have experimented with different types of adhesives, substituting organic adhesives, mastics, and other flexible adhesives for the traditional portland cement thin set. In addition, some installers will cut a control joint into the mortar bed between the V-Cap and field tile, in an attempt to direct any movement to the grout joint and not the time.

None of these approaches have proved satisfactory, however.

OBJECTS AND SUMMARY OF THE INVENTION

It is therefore an object of the invention to provide an improved tile installation method and apparatus;

It is a further object of the invention to provide an improved method and apparatus for installing V-Cap;

It is a still further object of the invention to provide a method and apparatus for installing cap strip which significantly reduces or eliminates the problem of hairline cracking of the V-Cap.

These and other objects are achieved according to the invention by providing a cap anchor component which is inserted into the mortar bed prior to setting. When the mortar sets, a bond is formed between it and the cap strip via the anchor component, thereby preventing cracking of the overlying V-Cap. The anchor component may be either a unitary discrete component or prefabricated to be punched out of the cap strip.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a readily manufacturable and particularly effective cap anchor component and system.

Figure 1:
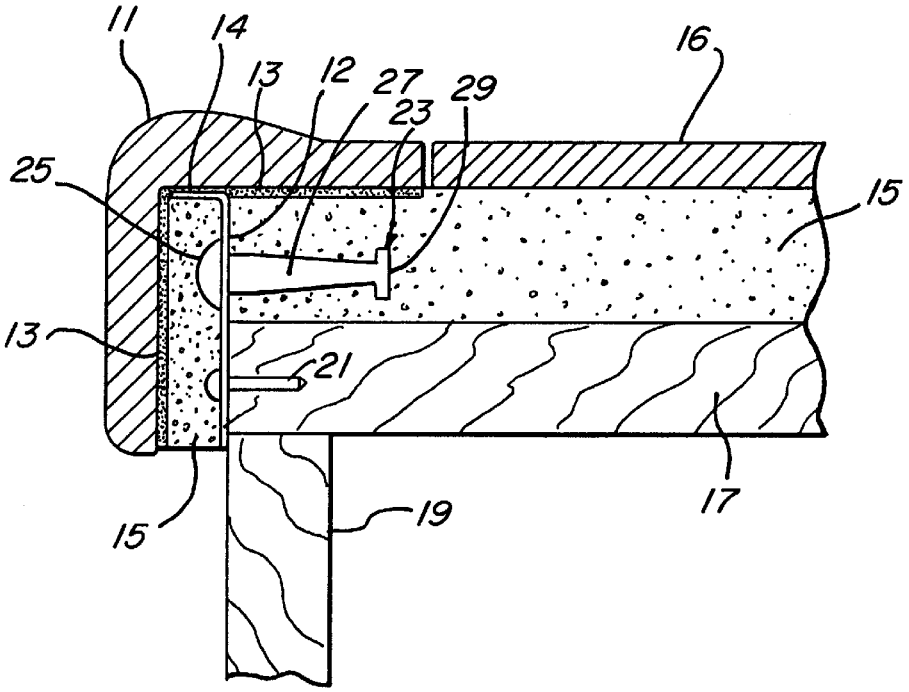
FIG. 1 is a cross-sectional drawing illustrating a cap strip installation according to the preferred embodiment.
Figure 2:
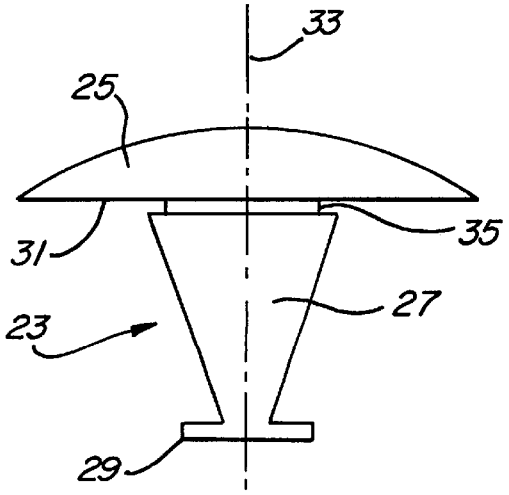
FIG. 2 is a side view of a cap anchor according to a first embodiment.
Figure 3:
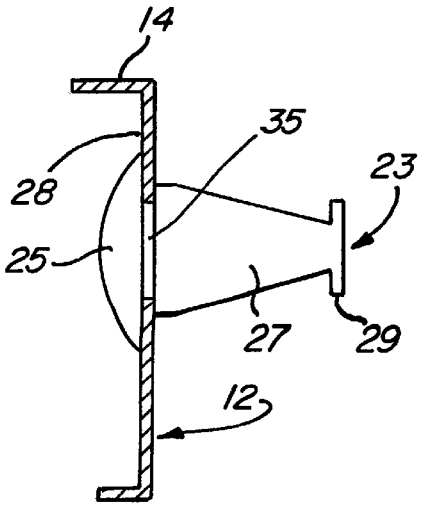
FIG. 3 is a cross-sectional drawing illustrating a cap anchor and metal cap strip according to a first embodiment.
Figure 4:
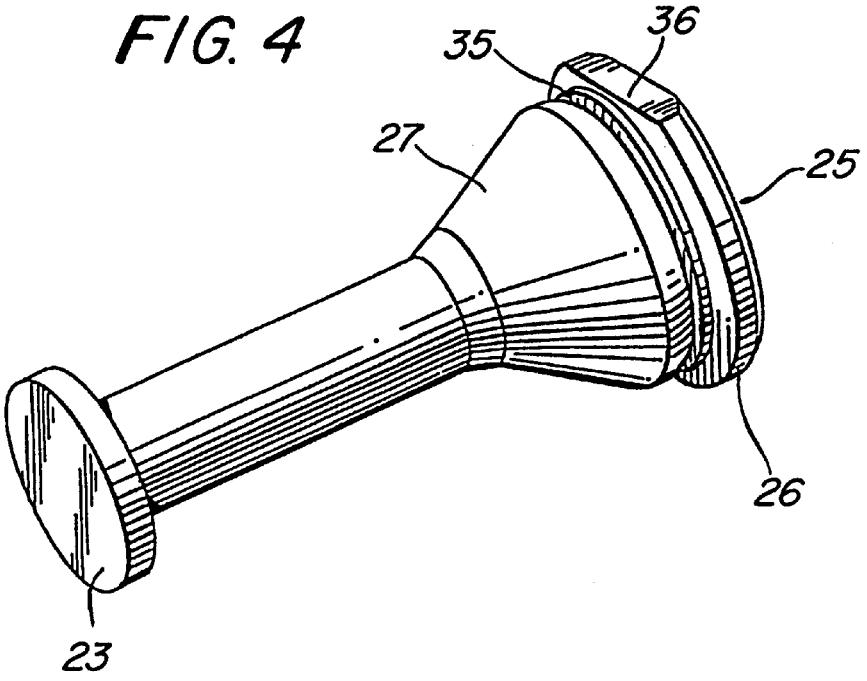
FIG. 4 is a perspective view of a cap anchor according to a first embodiment.
Figure 5:
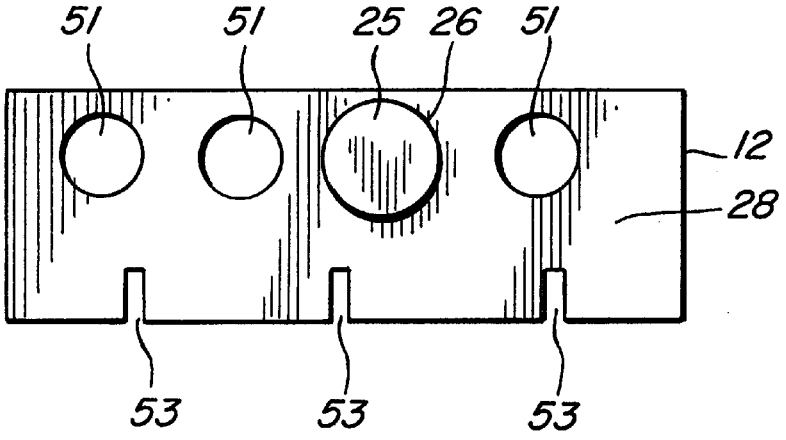
FIG. 5 is a front view of a cap strip component suitable for use with the preferred embodiment.

FIG. 1 illustrates a cap anchor component 23 according to the preferred embodiment installed in a tile assembly. The cap anchor component 23 is shown inserted through a cap strip 12 and surrounded by mortar 15. As may be seen, the cap anchor 23 includes a head portion 25 located on one side of the cap strip 12, a tapered stem portion 27 located on the opposite side of the cap strip 12, and an enlarged end portion or flange 29 formed at the end of the stem 27.

The cap strip 12 is anchored to a wood decking member 17 by suitable nails or other fasteners 21, typically inserted through preformed slots in the cap strip 12. The cap strip 12 further includes a flange 14 formed at a right angle to the cap strip face 28. The flange 14 is embedded in adhesive layer 13, typically a thin set mortar.

The V-Cap 11 typically runs parallel to the edge of a countertop in an installation of countertop tiles, e.g., 16. The flange 14 of the cap strip 12 is effectively attached to the V-Cap 11 by the adhesive layer 13. Provision of the cap anchor component 23 enables the cap strip 12 and mortar 15 to move as a unit such that the cap strip 12 does not separate from the mortar 15.

A first cap anchor design is illustrated in FIGS. 2–5. The head 25 of the cap anchor 23 has a circular periphery 26 resulting in creation of an annular surface 31 for abutting the outer face 28 (FIG. 5) of the cap strip 12. The stem portion 27 of the cap anchor 23 may be conically tapered symmetrically about central axis 33 to terminate in a disk-shaped flange 29. A recess of circular outer periphery 35 is formed between surface 31 and the stem 27. The recess 35 snaps into and interlocks with one of the circular openings 51 provided in the cap strip 12. The head 25 may further have a flattened portion 36, which is designed to abut the underside of flange 14 in the event that holes 51 are located closer than normal to flange 14.

The cap anchor components 23 may be of many other shapes besides that illustrated without departing from the scope or the spirit of the invention. It is, of course, preferred to employ a cap anchor shape which lends itself readily to plastic injection molding techniques, which are presently viewed as the preferred method of fabrication of the cap anchor components 23. In such case, the anchor components 23 may be hollow.

Figure 6:
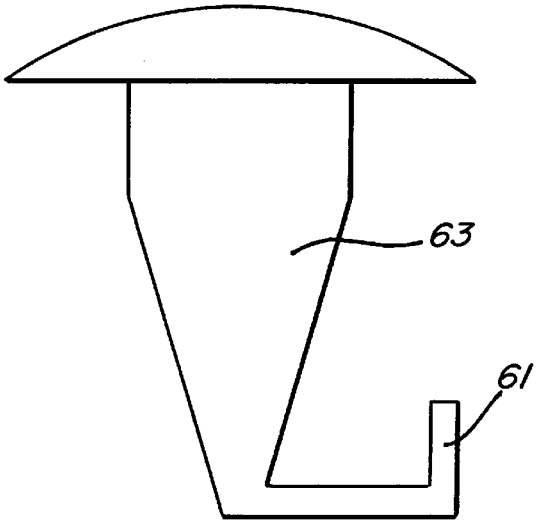
FIG. 6 is a side view of an alternate embodiment.

As to variations in shape, the end portions 29 may be of any shape which facilitates rigidly securing the stem portion 27 in the surrounding mortar 15. One alternative end portion 29 is illustrated in FIG. 6, where an arm 61 is illustrated extending to one side only of a stem portion 63. Stem portions such as 27 could be fabricated of various cross-sectional contours permitting passage through holes such as 51.

Figure 7:
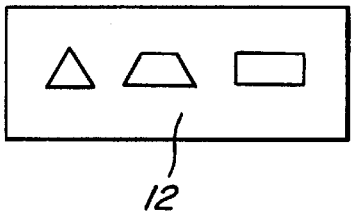
FIG. 7 is a front view of a cap strip illustrating alternate shapes for the cap strip holes.

Holes 51 could also be of many other geometric contours besides circular. Such holes could be, for example, triangular, trapezoidal, or rectangular as illustrated in FIG. 7, or any other irregular curve. Correspondingly, the outer periphery of recess 35 would be of the corresponding contour, e.g., triangular, trapezoidal, or rectangular to provide suitable interlocking with the cap strip. In a rectangular embodiment for example, interlocking could be provided on two parallel sides of the opening only, if desired, with similar selective locking being applied with respect to other geometric shapes for holes 51.

Figure 8:
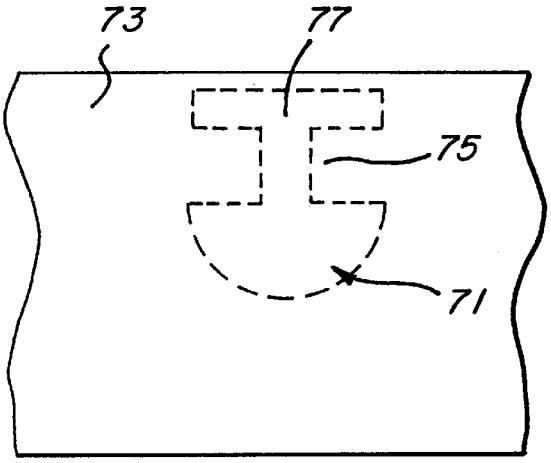
FIG. 8 is a front view of a cap strip segment illustrating an alternate embodiment.
Figure 9:
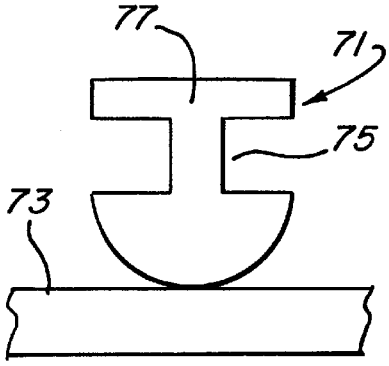
FIG. 9 is a top view of the cap strip of FIG. 8 with the cap strip anchor in the punched-out state.

FIGS. 8 and 9 illustrate an alternative embodiment wherein a cap strip anchor 71 is formed as part of the cap strip 73 itself. In this embodiment, the cap strip metal is perforated or otherwise prefabricated so that a spade-shaped anchor 71 may be punched out of the metal prior to installation. The anchor 71 may again be viewed as having a stem portion 75 and an enlarged end portion 77. FIG. 8 is a front view of the cap strip 73 illustrating the anchor 71 prior to punching out, while FIG. 9 is a top view of the cap strip 73 illustrating the anchor 71 after it has been punched out and is ready for insertion into a mortar layer. Again, a myriad of geometric shapes besides the spade shape shown could be used to create a suitable punched-out anchor.

Figure 10:
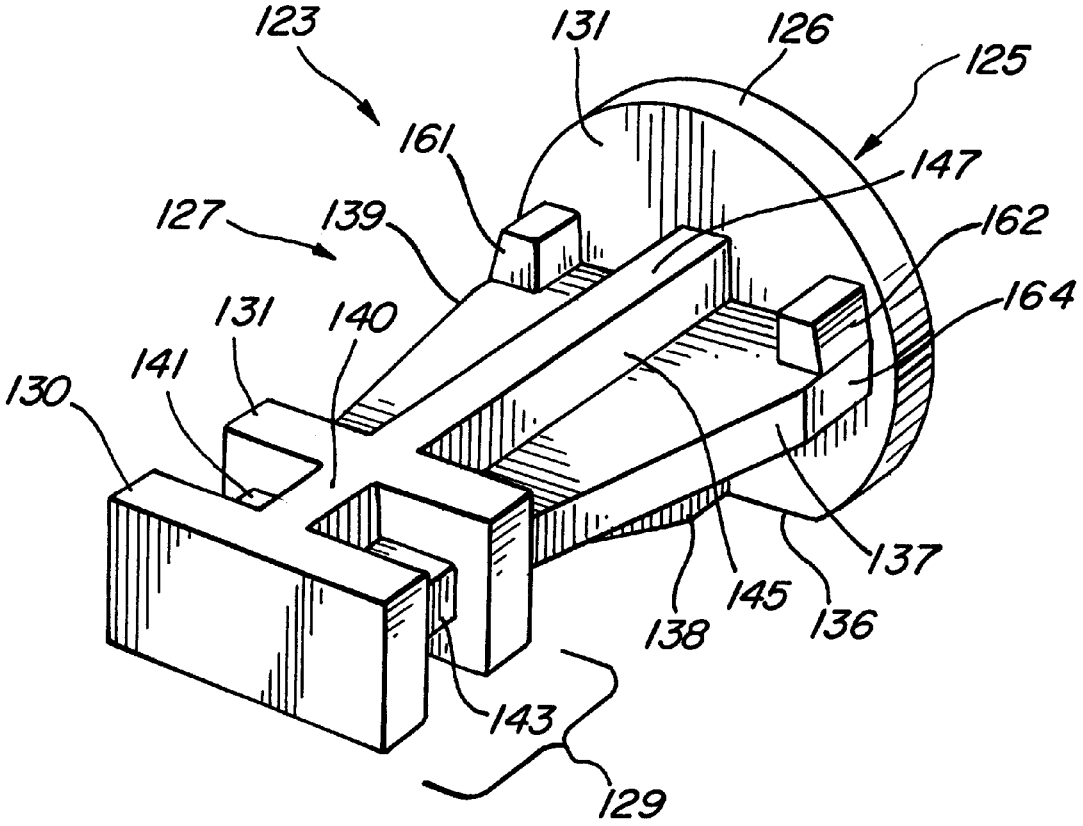
FIG. 10 is a perspective view of a cap anchor component according to the preferred embodiment.

FIG. 10 illustrates a cap anchor component 123 according to the preferred embodiment. As may be seen, the cap anchor 123 includes a head portion 125, stem portion 127 and an enlarged end portion 129 formed at the end of the stem 127.

The head 125 of the cap anchor 123 has a circular periphery 126 resulting in creation of a flat vertical surface 131 for abutting the outer face 28 (FIG. 5) of the cap strip 12. The head 125 further has a flattened peripheral portion 136, which is designed to abut the underside of flange 14 in the event that the cap strip holes 51 are located closer than normal to the cap strip flange 14.

The stem portion 127 of the cap anchor 123 has a central rib 138 which tapers linearly downward to terminate at the first of two parallel, rectangular-shaped flanges 130, 131, which form part of end portion 129. The two flanges 130, 131 are spaced apart from, and connected to one another, by a vertical rib 140 and first and second horizontal interior ribs 141, 143.

First and second side ribs 137, 139 are located on either side of the central rib 138 at positions rotated 90° away from central rib 138. The first and second side ribs are further identical in shape to rib 138.

Figure 11:
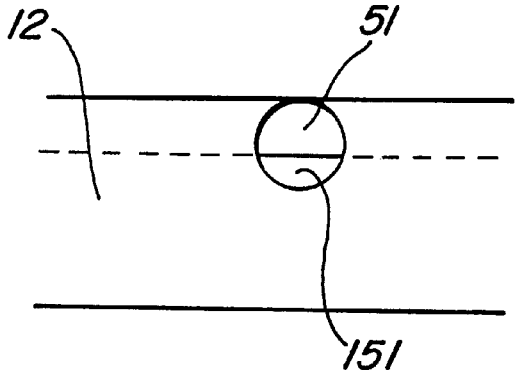
FIG. 11 is a front view of a cap strip component illustrating various insertion obstacles which may be overcome by the component of FIG. 10.

A fourth rib 145 is located directly opposite the central rib 138. In contrast to ribs 137, 138, 139, this rib 145 has a flat top surface 147, which is in the same plane as the top surface of the vertical rib 140. Provision of the flat low profile rib 145 permits the anchor component 123 to be inserted through holes 51 in a cap strip 12 which are partially obstructed, for example, by the edge 151 of a piece of plywood, as shown in FIG. 11. Thus, it will be appreciated that FIGS. 10, 12 and 13 illustrate the anchor component 123 in what would be normally considered a "bottom side up" position in order to illustrate various of its features.

Figure 12:
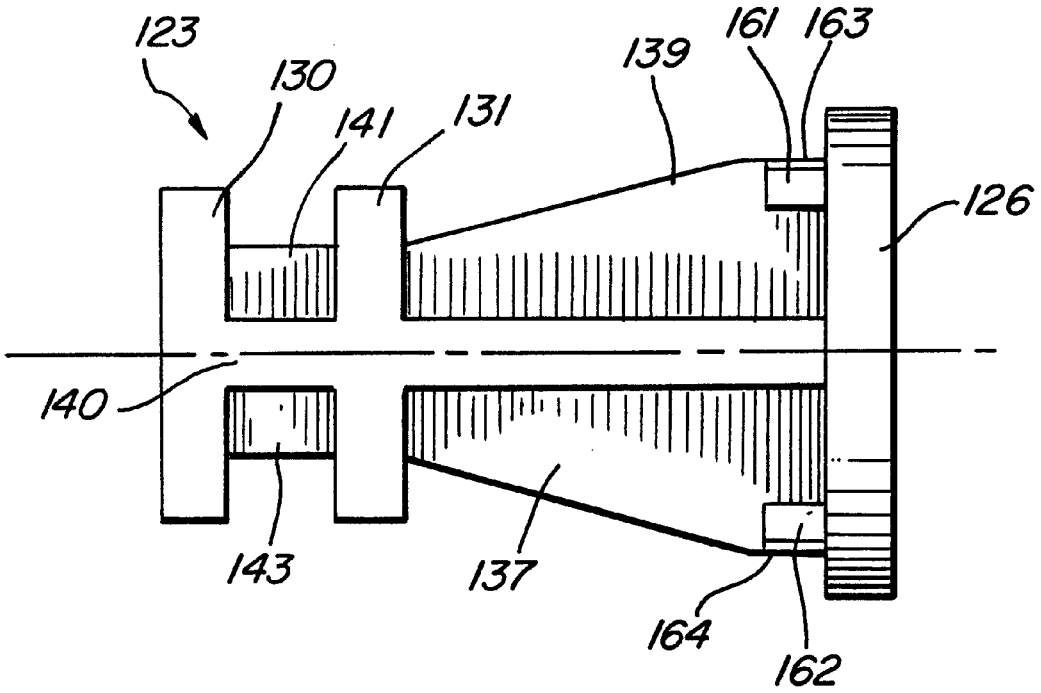
FIGS. 12 and 13 are side and bottom views of the component of FIG. 10, respectively.

A final feature illustrated in FIGS. 10, 12 and 14 are two small blocks 161, 162, which are located at the outer edges of a respective side rib 137, 139. These blocks 161, 162 add sturdiness and, together with the rectangular side surface portions 163, 164 of the side ribs 137, 139, form a side surface dimensioned to provide a locking "snap-in" press fit between a circular hole 51 and the anchor component 123. This press fit effectively locks the cap strip 12 to move in unison with the anchor component 123.

Figure 13:
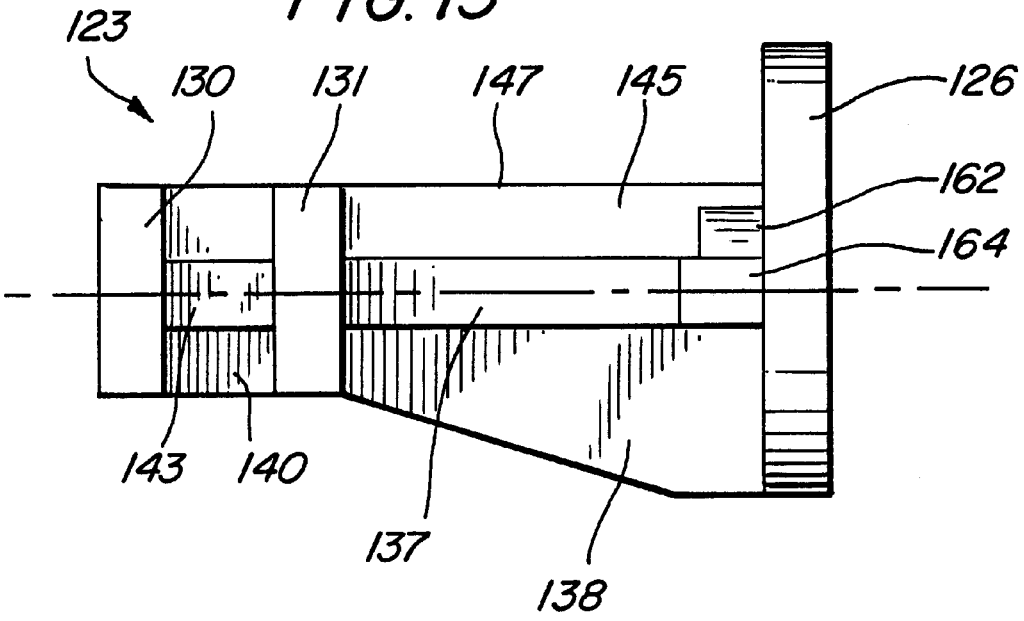

Anchor components 123 according to FIGS. 10, 12, and 13 are preferably injection molded as a single piece. One plastic material for molding components 123 is ABS (acryloniprile-butadiene-styrene) plastic. The dual flange design of FIG. 10 has been found to exhibit superior locking properties, while other of its features add to flexibility of use and economy of the product. In a typical installation, anchor components 123 are spaced every four inches or so along the cap strip.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An apparatus comprising:

means for anchoring a cap strip to surrounding mortar, said means for anchoring including:

a stem means for extending from said cap strip into an area where mortar is to be applied and for spacing an end portion thereof apart from said cap strip and into said area;

said end portion being shaped to interlock with subsequently applied mortar;

means attached to said stem means for causing said cap strip to move in unison with said stem means; and a V-cap component, said V-cap component comprising part of a tile installation assembly, said assembly including said cap strip.

2. The apparatus of claim 1 wherein said means attached to said stem means comprises a head means for abutting said cap strip upon insertion of said stem means through a hole in said cap strip.

3. The apparatus of claim 1 wherein said means attached to said stem means comprises a portion of said cap strip.

4. The apparatus of claim 1 wherein, said stem means, said means attached to said stem means, and said end portion further cooperate to unite said cap strip and mortar together to move as a unit.

5. The apparatus of claim 2 further including a recess means between said head means and stem means for interlocking with said hole.

6. A method of installing one or more V-Cap components comprising the steps of:

attaching a cap strip to a decking surface;

providing an anchor component positioned to extend into mortar located adjacent said cap strip and shaped to cause said cap strip to move in unison with said mortar once said mortar is set;

applying mortar to said decking surface adjacent the side surface of said cap strip so as to surround said anchor component with mortar; and applying said one or more V-Cap components to a corner surface formed on said mortar.

7. The method of claim 6 wherein said anchor component comprises a discrete component inserted through a hole in said cap strip.

8. The method of claim 7 wherein said anchor component includes a head having a surface larger than said hole and a recess located adjacent said head.

9. The method of claim 6 wherein said step of providing includes the step of providing a prefabricated anchor component in said cap strip and punching out said anchor component to a location where said anchor component is positioned to extend into mortar located adjacent said cap strip.

10. A construction assembly comprising:

a decking member;

a cap strip anchored to said decking member and having a portion extending above said decking member, said portion of said cap strip including a hole therein;

an anchor member having a stem portion inserted through said hole and a head portion attached to said stem portion, said head portion having a surface abutting the surface area of said cap strip surrounding said hole, said anchor member further having an end portion attached to said stem portion, said end portion being shaped to anchor said stem portion in position with respect to surrounding mortar;

mortar surrounding said anchor member; and a V-Cap component attached to said cap strip above said anchor member.

11. A construction assembly comprising:

a decking member;

a cap strip anchored to said decking member and having a portion extending above said decking member, said portion of said cap strip including a hole therein;

an anchor member having a stem portion punched out from the surface of said cap strip and attached thereto, said anchor member further having an end portion attached to said stem portion, said end portion being shaped to anchor said stem portion in position with respect to surrounding mortar;

mortar surrounding said anchor member; and a V-Cap component attached to said cap strip above said anchor member.

12. The apparatus of claim 1 wherein said end portion means comprises first and second parallel flanges spaced apart from one another.

13. The apparatus of claim 12 wherein said flanges are each rectangular in shape.

14. The apparatus of claim 1 wherein said stem means comprises four ribs, at least three of which are tapered from a wider portion adjacent said means attached to said stem means to a narrower portion adjacent said end portion.

15. The apparatus of claim 12 wherein said stem means comprises four ribs, at least three of which are tapered from a wider portion adjacent said means attached to said stem means to a narrower portion adjacent said end portion.

16. The apparatus of claim 15 further including first and second blocks, each located on a wider portion of said ribs.

17. The apparatus of claim 14 wherein said ribs are spaced apart by 90 degrees from one another.

18. The apparatus of claim 17 wherein one of said ribs comprises means for permitting said means for anchoring to be inserted despite partial obstruction of an opening in a cap strip.

19. A cap anchor comprising:

a head portion;

a stem portion connected to said head portion and comprising four ribs, at least three of said ribs being tapered from a wider portion adjacent said head portion to a narrower portion adjacent an end portion of said stem portion.

20. The apparatus of claim 19 wherein said end portion comprises first and second parallel flanges spaced apart from one another.

21. The apparatus of claim 20 further including first and second blocks, each located on a wider portion of said ribs.

22. The apparatus of claim 21 wherein said ribs are spaced apart by 90 degrees from one another.

23. The apparatus of claim 19 wherein one of said ribs comprises means for permitting said cap anchor to be inserted into a cap strip despite partial obstruction of an opening in said cap strip.

24. An apparatus comprising:

means for anchoring a cap strip to surrounding mortar, said means for anchoring including:

a stem means for extending from said cap strip into an area where mortar is to be applied and for spacing an end portion thereof apart form said cap strip and into said area;

said end portion comprising first and second parallel flanges spaced apart from one another for interlocking with subsequently applied mortar; and means attached to said stem means for causing said cap strip to move in unison with said stem means.

25. The apparatus of claim 24 wherein said first and second flanges are each rectangular in shape.

* * * * *